US005564966A

United States Patent [19]

Nishioka et al.

[11] Patent Number: 5,564,966

[45] Date of Patent: Oct. 15, 1996

[54] GRIND-MACHINING METHOD OF CERAMIC MATERIALS

[75] Inventors: Takao Nishioka; Takehisa Yamamoto; Yasushi Ito; Akira Yamakawa, all of Itami, Japan

[73] Assignee: Sumitomo Electric Industries, Ltd., Japan

[21] Appl. No.: 200,997

[22] Filed: Feb. 24, 1994

[30] Foreign Application Priority Data

Nov. 8, 1993 [JP] Japan ..... 5-302311

[51] Int. Cl.[6] ..... B24B 1/00

[52] U.S. Cl. ..... 451/41; 451/28; 451/178

[58] Field of Search ..... 451/28, 53, 57, 451/41, 178, 182, 212, 231

[56] References Cited

U.S. PATENT DOCUMENTS

| | | | |
|---|---|---|---|
| 455,391 | 7/1891 | Eberhardt . | |
| 945,674 | 1/1910 | Barnes . | |
| 2,551,948 | 5/1951 | Hutchinson . | |
| 4,227,841 | 10/1980 | Hoover | 408/197 |
| 4,619,564 | 10/1986 | Jacobson | 408/146 |
| 4,663,890 | 5/1987 | Brandt | 51/283 R |
| 4,839,996 | 6/1989 | Sekiya | 51/281 R |

FOREIGN PATENT DOCUMENTS

| | | | |
|---|---|---|---|
| 312830 | 4/1989 | European Pat. Off. | B24B 5/04 |
| 1117970 | 11/1961 | Germany . | |
| 548591 | 9/1956 | Italy . | |
| 332948 | 11/1972 | U.S.S.R. . | |
| 816751 | 7/1959 | United Kingdom . | |

OTHER PUBLICATIONS

Database WP1, week 9328, AN 93-223797 JPA-5-146,972; Jun. 15, 1993.

*Primary Examiner*—Bruce M. Kisliuk
*Assistant Examiner*—Eileen P. Morgan
*Attorney, Agent, or Firm*—Jordan B. Bierman; Bierman and Muserlian

[57] ABSTRACT

A grind-machining method of ceramic materials characterized in that a peripheral speed of a grinding wheel relative to a working surface is set to 50 to 300 m/sec, a feed stroke speed of the working surface of the grinding wheel in a working direction is set to 50 to 200 m/min, and preferably, a down-feed speed of the working surface of the grinding wheel in a direction orthogonal to the surface of the workpiece is set to 0.05 to 3 mm/min. The grind-machining method of ceramic materials can reduce a grinding force at the time of grinding of ceramic materials and residual defects due to machining, and at the same time, can accomplish high machining efficiency.

4 Claims, 1 Drawing Sheet

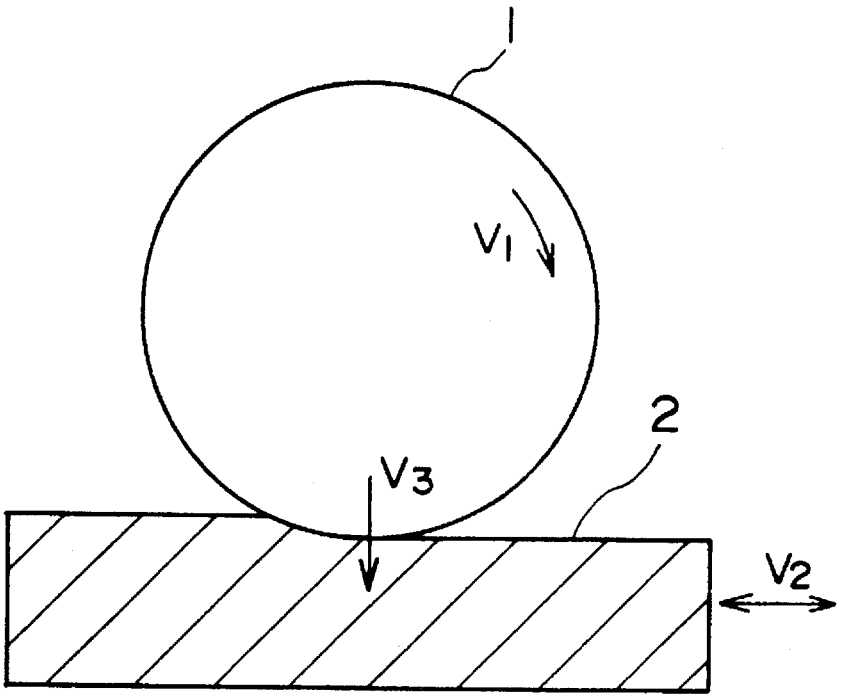
1
V1
2
V3
V2

GRIND-MACHINING METHOD OF CERAMIC MATERIALS

BACKGROUND OF THE INVENTION

1. Field of the Invention

This invention relates to a grind-machining method for machining ceramic materials into a groove shape or a concavo-convex shape or cutting them using a grinding wheel in order to produce mechanical components made of ceramics.

2. Description of the Prior Art

Ceramic materials generally have excellent mechanical properties in hardness, strength and heat-resistance or the like, and their application as mechanical structural materials is expected. However, since the ceramic materials are typical hard and brittle materials, various problems remain unsolved in the aspect of the selection of machining methods for providing necessary geometric shapes for final products, strength or fatigue life after machining.

Grind-machining by diamond wheels has gained the widest application at present as a machining method of ceramic materials. Grind-machining using the diamond wheels is an excellent machining method in the aspects of versatility of machining equipment and a machining cost. Because the ceramic materials are the hard and brittle materials as described above, however, damages such as cracks or defects remain on the machined surface, resulting in the drop of the strength, life or reliability and preventing in most cases the practical application of the machined products.

It is known, for example, that the depth of cracks introduced at the time of grinding is affected by the grain size of the diamond grains and is as great as 20 to 40 μm in the case of a silicon nitride material (Yoshikawa, "FC Report", Vol. 8, No. 5, p. 148 (1990)). The order of this crack depth is believed to be a fatal defect for practical mechanical components.

It is reported that a correlationship exists between the surface roughness of the ground surface of the silicon nitride material and its flexural strength, and the surface coarseness must be limited to below 1 μm so as to maintain reliability of the strength (Itoh, "The Latest Fine Ceramics Technique", edited by Kogyo Chosakai, p. 219, (1983)).

Accordingly, there is the case where the method of securing reliability of the strength must be employed by grinding the surface layer, where defects remain, by free grains, such as lapping or polishing after grinding by diamond wheels to remove any defects. However, such an additional grinding work is extremely disadvantageous economically.

From the aspect of machining efficiency, on the other hand, it is known that machining efficiency can be drastically improved by adding a machining pressure above critical value in the grinding work of ceramic materials (Tomimori, "FC Report", Vol. 1, No. 8, p. 5 (1983)). However, experimental evaluation made by the present inventors reveals that the critical value of the machining pressure drastically increases with the improvement in the characteristics of the ceramic materials such as the hardness, the toughness, the bending strength, etc., by the improvement in the production method, and so forth.

Generally, the increase of the machining pressure can be obtained by increasing the mechanical rigidity of machining equipment. With the increase of the critical value of the machining pressure resulting from the improvement of the characteristics of the ceramic materials, however, there is a limit to the increase of the machining rigidity, and the increase of the machining cost arises due to this increase of rigidity. Furthermore, the increase of the machining pressure causes the residual defects more likely to occur in the workpieces.

As described above, mutual dependence exists between machining efficiency and the residual defects after machining in the grinding work of the ceramic materials, so that when machining efficiency is improved, the residual defects increase and machining efficiency must be limited to a low level in order to reduce the residual defects.

SUMMARY OF THE INVENTION

In view of the problems with the prior art as described above, the present invention aims at providing a grind-machining method of ceramic materials which reduces a grinding force in a grinding work of a workpiece made of ceramic materials, limits the defects of the workpiece surface to such a level as not to greatly affect the characteristics of the workpiece, and at the same time, can accomplish high machining efficiency.

To accomplish the object described above, a grind-machining method of ceramic materials according to the present invention is characterized in that a peripheral speed of a grinding wheel working surface is set to 50 to 300 m/sec and a feed stroke speed of the grinding working surface in a working direction is set to 50 to 200 m/min in the grinding work of ceramic materials.

To further improve machining efficiency, down-feed speed of the grinding wheel working surface in a direction orthogonal to the workpiece surface is preferably set to 0.05 to 3 mm/min, in addition to the limitations to the feed speed and the peripheral speed of the grinding wheel working surface described above.

BRIEF DESCRIPTION OF THE DRAWING

The single figure is a schematic illustration of a side view showing the outline of reciprocating type surface grind-machining, and is useful for explaining the grind-machining conditions in the method of the present invention.

DETAILED DESCRIPTION OF THE PREFERRED EMBODIMENTS

The figure shows each speed of the grinding wheel in the present invention in the case of reciprocating type surface grinding by way of example. The feed stroke speed of the grinding wheel working surface in the working direction is a relative moving speed between the grinding wheel 1 and the workpiece 2 in the working direction in which grinding proceeds, and corresponds to symbol $V_2$ in the drawing. The down-feed speed of the grinding wheel working surface in a direction orthogonal to the workpiece surface is represented by symbol $V_3$, and symbol $V_1$ represents the peripheral speed of the grinding wheel working surface.

In the grind-machining process of the present invention, the peripheral speed of the grinding wheel working surface is set to a high speed range of 50 to 300 m/sec. Since the grain depth of cut of individual grains to the workpiece can thus be set to a small value, the grinding force when the individual grains grind the workpiece can be reduced, so that defects remaining in the workpiece such as cracks can be considerably reduced.

The effect described above cannot be obtained when the peripheral speed is less than 50 m/sec, and when peripheral speed exceeds 300 m/sec, the workpiece might be broken due to external force resulting from the centrifugal force of the grinding wheel and since the grain depth of cut of the individual grains becomes extremely small, the grains slip on the workpiece surface. Further, a driving portion becomes greater in size so as to meet a high speed revolution need, and an economical disadvantage also occurs.

Considerable reduction of the residual defects as well as improvement in machining efficiency can be accomplished by setting the feed stroke speed of the grinding wheel working surface in the working direction to 50 to 200 m/min, besides the high peripheral speed described above. In the case of a surface grinder of an ordinary reciprocating type grinding system where the workpiece repeats reciprocation, the feed speed in the range described above corresponds to 100 to 500 reciprocating motions/min.

When the feed stroke speed of the grinding wheel working surface in the working direction is less than 50 m/min, the improvement in machining efficiency cannot be expected and if it exceeds 200 m/min, a high impact force acts on the workpiece when the grinding wheel working surface starts machining. Accordingly, defects such as cracks are more likely to be introduced into the workpiece.

To further improve machining efficiency, the down-feed speed of the grinding wheel working surface in the direction orthogonal to the workpiece surface is preferably set to 0.05 to 3 mm/min in addition to the peripheral speed and the feed speed of the grinding wheel working surface described above. When this down-feed speed is less than 0.05 m/min, the effect of improving machining efficiency cannot be obtained, and when it exceeds 3 mm/min, the grinding force to the workpiece becomes so great that the defects such as cracks remain in the workpiece after machining.

Preferably, oscillation of the grinding wheel working surface is suppressed to a level as low as possible. In other words, as to oscillation in the direction orthogonal to the workpiece surface, amplitude is preferably limited to not more than 0.5 μm, and as to oscillation in a parallel direction, the amplitude is preferably limited to 0.7 μm or less. When oscillation of the grinding exceeds these conditions, an impact is imparted to the workpiece and this impact promotes the occurrence of the defects such as cracks, lowers machining accuracy or results in early breakage of the grinding wheel.

To stably operate the grinding wheel in such an oscillation amplitude range and to carry out grinding under the conditions of the peripheral speed and the feed speed of the grinding wheel, a grinding wheel spindle for fitting the grinding wheel is preferably supported by a fluid static pressure bearing such as air or oil. When an ordinary bearing such as ball bearing or a roller bearing is used, wear of the balls and the rollers results in the occurrence of oscillation of the bearing, and oscillation of the bearing in turn increased the oscillation amplitude of the grinding wheel working surface.

In the grind-machining method according to the present invention, there is no particular limitation to the ceramic materials as the workpiece. However, the present invention provides a remarkable effects to those materials which have excellent material characteristics such as the hardness and strength, and hence, for which a machining pressure necessary for obtaining high machining efficiency becomes high. Examples of such ceramic materials are silicon nitride, sialon, zirconia, silicon carbide, aluminum nitride, aluminum oxide and composite materials obtained by reinforcing these ceramic materials by fibers, whiskers, dispersed particles, and so forth.

The grains of the grinding wheel used for the grinding method of the present invention are preferably diamond grains or cubic system boron nitride (c-BN). Since a large centrifugal force acts on these grains at the time of high speed revolution, the grains are preferably bonded by a metallic or ceramic type binder. When a resin type binder is used as in the case of a grinding wheel used for the grind-machining of ordinary ceramic materials, the grinding wheel will undergo deformation due to the centrifugal force because the rigidity of the binder is not sufficient so that machining accuracy drops or the grinding wheel cannot withstand a high grinding temperature during high speed revolution.

Incidentally, the grind-machining method of the ceramic materials according to the present invention is particularly effective for shape grinding by reciprocation type surface grinders and cutting by a sharp edge grinding wheel.

EXAMPLE 1

The following commercially available ceramic materials were prepared as the workpieces to be machined. Strength values shown in MPa units within parentheses are3-point bending strength according to JIS R1601.

* $Si_3N_4$ sintered body (1) (800 MPa)
* $Si_3N_4$ sintered body (2) (1300 MPa)
* $ZrO_2$ sintered body (1) (1200 MPa)
* $ZrO_2$ sintered body (2) (2000 MPa)
* $Al_2O_3$ sintered body (500 Mpa)
* SiC sintered body (500 MPa)
* AlN sintered body (350 MPa)

Each of the ceramic materials listed above was subjected to ordinary reciprocating plunge cut wet surface grinding using a diamond wheel (grain size: 100 to 150 μm, binding material: metal bond) of SDC 100P75M having a diameter of 200 mm and a width of 5 mm by changing a peripheral speed $V_1$ (m/sec) of a grinding wheel working surface and a feed stroke speed $V_2$ (m/min) of the grinding wheel working surface in a working direction. Machining efficiency in each grinding test was evaluated by a material removal rate ($mm^3$/mm sec) obtained by dividing a work machining quantity per unit width of the grinding wheel working surface by a unit grinding time, and was listed in Table 1 below.

In each grinding test, however, the grinding force was a value representing a component Fn in a direction orthogonal to the contact surface between the grinding wheel working surface and the workpiece per unit width of the grinding wheel working surface, and was kept always at 1.0 kgf/mm (constant), and a down-feed speed $V_3$ (mm/min) in the direction orthogonal to the surface of the workpiece on the grinding wheel working surface was regulated and set for each grinding test so that the grinding force attained the constant value described above. Further, control was made by measuring an oscillation amplitude of the grinding wheel working surface by an optical displacement detector so that the oscillation amplitude in the orthogonal direction to the surface of the workpiece became below 0.1 μm and the oscillation amplitude in a parallel direction was below 0.5 μm.

TABLE 1

| sample | ceramic material | peripheral speed $V_1$ (m/sec) | feed stroke speed $V_2$ (m/min) | material removal rate ($mm^3$/mmsec) |
|---|---|---|---|---|
| 1* | $Si_3N_4$ sintered body (1) | 25 | 15 | 1.5 |
| 2* | $Si_3N_4$ sintered body (1) | 150 | 15 | 3.2 |
| 3* | $Si_3N_4$ sintered body (1) | 25 | 100 | 2.8 |
| 4 | $Si_3N_4$ sintered body (1) | 100 | 50 | 6.6 |
| 5 | $Si_3N_4$ sintered body (1) | 200 | 150 | 9.2 |
| 6 | $Si_3N_4$ sintered body (1) | 300 | 200 | 11.4 |
| 7* | $Si_3N_4$ sintered body (2) | 25 | 15 | 0.5 |
| 8* | $Si_3N_4$ sintered body (2) | 150 | 15 | 1.2 |
| 9* | $Si_3N_4$ sintered body (2) | 25 | 100 | 1.0 |
| 10 | $Si_3N_4$ sintered body (2) | 100 | 50 | 3.2 |
| 11 | $Si_3N_4$ sintered body (2) | 200 | 150 | 4.5 |
| 12 | $Si_3N_4$ sintered body (2) | 300 | 200 | 6.0 |
| 13* | $ZrO_2$ sintered body (1) | 25 | 15 | 2.0 |
| 14* | $ZrO_2$ sintered body (1) | 150 | 15 | 3.8 |
| 15* | $ZrO_2$ sintered body (1) | 25 | 100 | 3.2 |
| 16 | $ZrO_2$ sintered body (1) | 100 | 50 | 8.0 |
| 17 | $ZrO_2$ sintered body (1) | 200 | 150 | 10.5 |
| 18 | $ZrO_2$ sintered body (1) | 300 | 200 | 13.8 |
| 19* | $ZrO_2$ sintered body (2) | 25 | 15 | 1.4 |
| 20* | $ZrO_2$ sintered body (2) | 150 | 15 | 2.6 |
| 21* | $ZrO_2$ sintered body (2) | 25 | 100 | 2.2 |
| 22 | $ZrO_2$ sintered body (2) | 100 | 50 | 6.5 |
| 23 | $ZrO_2$ sintered body (2) | 200 | 150 | 9.2 |
| 24 | $ZrO_2$ sintered body (2) | 300 | 200 | 10.6 |
| 25* | $Al_2O_3$ sintered body | 25 | 15 | 4.2 |
| 26* | $Al_2O_3$ sintered body | 150 | 15 | 5.6 |
| 27* | $Al_2O_3$ sintered body | 25 | 100 | 5.5 |
| 28 | $Al_2O_3$ sintered body | 100 | 50 | 10.8 |
| 29 | $Al_2O_3$ sintered body | 200 | 150 | 13.5 |
| 30 | $Al_2O_3$ sintered body | 300 | 200 | 16.2 |
| 31* | SiC sintered body | 25 | 15 | 4.0 |
| 32* | SiC sintered body | 150 | 15 | 5.8 |
| 33* | SiC sintered body | 25 | 100 | 5.9 |
| 34 | SiC sintered body | 100 | 50 | 11.0 |
| 35 | SiC sintered body | 200 | 150 | 14.2 |
| 36 | SiC sintered body | 300 | 200 | 15.8 |
| 37* | AlN sintered body | 25 | 15 | 3.8 |
| 38* | AlN sintered body | 150 | 15 | 3.8 |
| 39* | AlN sintered body | 25 | 100 | 4.8 |
| 40 | AlN sintered body | 100 | 50 | 9.0 |
| 41 | AlN sintered body | 200 | 150 | 12.5 |
| 42 | AlN sintered body | 300 | 200 | 14.0 |

(NOTE):
Samples with asterisk (*) in Table are Comparative Examples.

It can be understood from the results listed above that excellent machining efficiency can be obtained when the peripheral speed and the feed speed of the grinding wheel working surface are within the ranges stipulated by the present invention, and the grind-machining method of the present invention is more effective for materials having higher characteristics among the ceramic materials of the same kind.

EXAMPLE 2

A tensile evaluation surface of each transverse test piece in accordance with JIS R1601 was subjected to grind-machining with a machining allowance of 50 μm in a direction orthogonal to the longitudinal direction of the test piece under the same machining condition as that of each of the Samples Nos. 1 to 12 and 25 to 30 of Example 1 using the same grinding wheel of Example 1. A three-point bending strength test was carried out on each of the resulting test pieces (represented by the same reference numeral as in Example 1) in accordance with JIS R1601, and the result is tabulated in Table 2. Incidentally, the reason why the grinding direction was orthogonal to the longitudinal direction of the test pieces was because strength dependence on the machining direction existed in the ceramic materials, and strength dependence was rated particularly high in the machining direction described above.

TABLE 2

| sample | ceramic material | peripheral speed $V_1$ (m/sec) | feed stroke speed $V_2$ (m/min) | 3-point bending strength (MPa) | Weibull modulus |
|---|---|---|---|---|---|
| 1* | $Si_3N_4$ sintered body (1) | 25 | 15 | 290 | 6.2 |
| 2* | $Si_3N_4$ sintered body (1) | 150 | 15 | 380 | 8.5 |
| 3* | $Si_3N_4$ sintered body (1) | 25 | 100 | 300 | 6.0 |
| 4 | $Si_3N_4$ sintered body (1) | 100 | 50 | 680 | 12.4 |
| 5 | $Si_3N_4$ sintered body (1) | 200 | 150 | 720 | 14.2 |
| 6 | $Si_3N_4$ sintered body (1) | 300 | 200 | 760 | 18.2 |
| 7* | $Si_3N_4$ sintered body (2) | 25 | 15 | 450 | 5.8 |
| 8* | $Si_3N_4$ sintered body (2) | 150 | 15 | 560 | 9.0 |
| 9* | $Si_3N_4$ sintered body (2) | 25 | 100 | 470 | 6.2 |
| 10 | $Si_3N_4$ sintered body (2) | 100 | 50 | 950 | 12.6 |
| 11 | $Si_3N_4$ sintered body (2) | 200 | 150 | 1050 | 15.0 |
| 12 | $Si_3N_4$ sintered body (2) | 300 | 200 | 1180 | 18.3 |
| 25* | $Al_2O_3$ sintered body | 25 | 15 | 180 | 4.4 |
| 26* | $Al_2O_3$ sintered body | 150 | 15 | 250 | 6.8 |
| 27* | $Al_2O_3$ sintered body | 25 | 100 | 200 | 5.2 |
| 28 | $Al_2O_3$ sintered body | 100 | 50 | 380 | 10.8 |
| 29 | $Al_2O_3$ sintered body | 200 | 150 | 430 | 12.3 |
| 30 | $Al_2O_3$ sintered | 300 | 200 | 460 | 15.4 |

(NOTE):
Samples with asterisk (*) in the table are Comparative Examples.

It can be understood from the results listed above that since the samples machined by the grinding method of the present invention had small residual defects resulting from machining, they could reduce the drop of the strength and had small variance of the strength (had a high Weibull modulus), and ceramic machined products having high reliability could be obtained in consequence.

EXAMPLE 3

Grinding was carried out for each of Samples 7 to 12, 19 to 24 and 31 to 36 among the Samples of Example 1 under the same machining condition as the condition of these Samples using the same grinding wheel as that of Example 1 so that the total machining volume became 2,000 $mm^3$. After grinding, a grinding ratio (total machining volume/total wear quantity of the grind wheel) was measured for each of the resulting Samples (indicated by the same reference numeral as in Example 1). The result is shown in Table 3.

TABLE 3

| sample | ceramic material | peripheral speed $V_1$ (m/sec) | feed stroke speed $V_2$ (m/min) | grinding ratio ($G_R$) |
|---|---|---|---|---|
| 7* | $Si_3N_4$ sintered body (2) | 25 | 15 | 145 |
| 8* | $Si_3N_4$ sintered body (2) | 150 | 15 | 212 |
| 9* | $Si_3N_4$ sintered body (2) | 25 | 100 | 187 |
| 10 | $Si_3N_4$ sintered body (2) | 100 | 50 | 380 |
| 11 | $Si_3N_4$ sintered body (2) | 200 | 150 | 502 |
| 12 | $Si_3N_4$ sintered body (2) | 300 | 200 | 588 |
| 19* | $ZrO_2$ sintered body (2) | 25 | 15 | 206 |
| 20* | $ZrO_2$ sintered body (2) | 150 | 15 | 283 |
| 21* | $ZrO_2$ sintered body (2) | 25 | 100 | 256 |
| 22 | $ZrO_2$ sintered body (2) | 100 | 50 | 402 |
| 23 | $ZrO_2$ sintered body (2) | 200 | 150 | 563 |
| 24 | $ZrO_2$ sintered body (2) | 300 | 200 | 639 |
| 31* | SiC sintered body | 25 | 15 | 302 |
| 32* | SiC sintered body | 150 | 15 | 388 |
| 33* | SiC sintered body | 25 | 100 | 346 |
| 34 | SiC sintered body | 100 | 50 | 465 |
| 35 | SiC sintered body | 200 | 150 | 603 |
| 36 | SiC sintered body | 300 | 200 | 688 |

(NOTE):
Samples with asterisk (*) in the table are Comparative Examples.

It can be understood from the results listed above that the grinding method according to the present invention can reduce wear of the grind wheel and can prolong the life of the grind wheel.

EXAMPLE 4

Grooving was carried out for the AlN sintered body of each of the Samples Nos. 37 to 42 of Example 1 under the same machining condition as these samples using a diamond grinding wheel having a diameter of 200 mm and a thickness of 1 mm, and the machining time before a groove having depth of 5 mm and a length of 100 mm was machined was measured for each sample. The results is shown in Table 4. In this case, a down-feed speed was regulated so that a component Fn in a direction orthogonal to the contact surface between the grinding wheel working surface and the workpiece became 3 kg or less and a component Ft in a parallel direction became 1 kg or less among the grinding force.

TABLE 4

| sample | ceramic material | peripheral speed $V_1$ (m/sec) | feed stroke speed $V_2$ (m/min) | machining time (sec) |
|---|---|---|---|---|
| 37* | AlN sintered body | 25 | 15 | 3600 |
| 38* | AlN sintered body | 150 | 15 | 2460 |
| 39* | AlN sintered body | 25 | 100 | 3230 |
| 40 | AlN sintered body | 100 | 50 | 480 |
| 41 | AlN sintered body | 200 | 150 | 420 |
| 42 | AlN sintered body | 300 | 200 | 300 |

(NOTE):
Samples with asterisk (*) were Comparative Examples.

It can be understood from the results listed above that the method of the present invention is an effective method of the present invention is an effective method having extremely high machining efficiency as a cutting method, too.

EXAMPLE 5

The ceramic material, that is, the $Si_3N_4$ sintered body (1) of Example 1 was subjected to grind-machining at the same peripheral speed $V_1$ (m/sec) of the grinding wheel working surface and at the same feed stroke speed $V_2$ (m/min) of the grinding wheel working surface in the working direction as in the case of Samples 1 and 5 of Example 1 but by changing the down-feed speed $V_3$ (mm/min) of the grinding wheel working surface in the direction orthogonal to the surface of the workpiece as listed in Table 5, with the other conditions being the same as in Example 1, using the same grinding wheel as that of Example 1.

The material removal rate and the grinding force (the component Fn in the direction orthogonal to the contact surface between the grinding wheel working surface and the workpiece) were measured for each of the samples obtained by the grind-machining described above, and the results are shown in Table 5.

TABLE 5

| sample | peripheral speed $V_1$ (m/sec) | feed stroke speed $V_2$ (m/min) | down-feed speed $V_3$ (m/min) | material removal rate ($mm^2$/mmsec) | grinding force Fn (kgf/mm) |
|---|---|---|---|---|---|
| 1-1* | 25 | 15 | 0.02 | 1.2 | 0.9 |
| 1-2* | 25 | 15 | 0.05 | 1.8 | 2.1 |
| 1-3* | 25 | 15 | 1.00 | 2.2 | 9.5 |
| 1-4* | 25 | 15 | 3.00 | 2.3 | 17.2 |
| 1-5* | 25 | 15 | 4.00 | 1.5 | 25.6 |
| 5-1 | 200 | 150 | 0.02 | 2.8 | 0.3 |
| 5-2 | 200 | 150 | 0.05 | 6.5 | 0.6 |
| 5-3 | 200 | 150 | 1.00 | 11.2 | 3.5 |
| 5-4 | 200 | 150 | 3.00 | 28.5 | 6.3 |
| 5-5 | 200 | 150 | 4.00 | 26.4 | 15.2 |

(NOTE):
Samples with asterisk (*) were Comparative Examples.

It can be understood from the results listed above that the grinding method of the present invention has higher machining efficiency under the same machining condition, and further higher machining efficiency can be obtained particularly within the range of the down-feed speed of 0.05 to 3 mm/sec.

The present invention can accomplish extremely high machining efficiency and at the same time, can reduce the grinding force. Accordingly, the present invention can remarkably reduce defects such as cracks remaining in the workpieces, can secure high reliability of the machined products while maintaining the characteristic properties such as the strength, can reduce wear of the abrasives, and can remarkably prolong the service life of the grinding wheel.

Particularly, the present invention can accomplish a remarkable improvement in machining efficiency under a machining condition not exceeding the upper limit value of the grinding force, at which defects such as cracks do not remain in the ceramic material as the workpiece, or not exceeding the upper limit value of the maximum grain depth of cut providing the upper limit value of this grinding force, in comparison with the conventional grind-machining methods.

Due to the reduction of the grinding force, the continuous cutting edge distance (the effective cutting edge distance) corresponding to the distance of the grains can be set to an extremely small value. Accordingly, the amount of the grains packed into the grinding wheel can be reduced to 50 to 75 in terms of the degree of concentration (75 to 100 according to the conventional grind-machining methods), and a more economical grinding wheel can be utilized. Further, the wear rate of the grinding wheel becomes lower due to the reduction of the grinding force, and its shape can be maintained for a long time. Accordingly, high shape machining accuracy can be secured easily.

For these reasons, the grind-machining method of the ceramic materials according to the present invention are suitable for grind-machining of aluminum nitride heat radiation fins for semiconductor devices, working molds of lead frames and for grind machining of various molds such as bending molds, three-dimensional shape magnetic heads and three-dimensional molds.

What is claimed is:

1. A grind-machining method of ceramic materials comprising grinding of ceramic materials using a grinding wheel, characterized in that a peripheral speed of a grinding wheel working surface is 50 to 300 m/sec and a feed stroke speed of said grinding wheel working surface in a working direction is 50 to 200 m/min.

2. A grind-machining method of ceramic materials according to claim 1, wherein a down-feed speed of said grinding wheel working surface in the direction orthogonal to the surface of a workpiece is set to 0.05 to 3 mm/min.

3. A grind-machining method of ceramic materials according to claim 1, wherein said ceramic material as said workpiece is a member selected from the group consisting of silicon nitride, sialon, zirconia, silicon carbide, aluminum nitride, aluminum oxide and their composite materials.

4. A grind-machining method of ceramic materials according to claim 2, wherein said ceramic material as said workpiece is a member selected from the group consisting of silicon nitride, sialon, zirconia, silicon carbide, aluminum nitride, aluminum oxide and their composite materials.

* * * * *